US005167078A

United States Patent [19]

Bolde et al.

[11] Patent Number: 5,167,078

[45] Date of Patent: Dec. 1, 1992

[54] COMPACT PHOTO RESIST DRYER

[75] Inventors: Lannie R. Bolde, New Paltz; John S. Groman, Kingston, both of N.Y.

[73] Assignee: International Business Machines Corp., Armonk, N.Y.

[21] Appl. No.: 783,454

[22] Filed: Oct. 24, 1991

[51] Int. Cl.[5] ..... F27D 11/00

[52] U.S. Cl. ..... 34/23; 34/202; 219/385; 219/398; 219/407

[58] Field of Search ..... 34/23, 150, 151, 202; 219/385, 398, 406, 407, 521

[56] References Cited

U.S. PATENT DOCUMENTS

| | | | |
|---|---|---|---|
| 3,052,040 | 9/1962 | Falanga et al. | 34/202 |
| 3,074,342 | 1/1963 | Wachtel | 99/399 |
| 3,412,234 | 11/1968 | Otavka | 219/407 X |
| 3,800,123 | 3/1974 | Maahs | 219/398 X |
| 4,238,669 | 12/1980 | Huntley | 219/405 |
| 4,298,789 | 11/1981 | Eichelberger | 219/406 |
| 4,554,437 | 11/1985 | Wagner et al. | 219/388 |

*Primary Examiner*—Robert G. Nilson
*Attorney, Agent, or Firm*—Laurence R. Letson

[57] ABSTRACT

A photo resist drier for curing photo resist coatings on a metal foil is described. The dryer has an enclosure made of copper sheet and surrounded by strip heaters to heat the enclosure. The enclosure, heated by the heaters conducts heat and accordingly results in a more uniform internal temperature in the enclosure. The heaters are individually controllable. The vapors are captured by an exhaust system and removed from the dryer.

13 Claims, 3 Drawing Sheets

COMPACT PHOTO RESIST DRYER

FIELD OF THE INVENTION

This invention relates to field of photo resist drying and specifically to an apparatus for drying the photo resist on a thin film or foil of metal while maintaining temperature and solvent concentration conditions at parameters that result in uniform and fast drying of the resist layer.

BACKGROUND OF THE INVENTION

Foils are coated with photo resist and the resist then dried or cured. After the resist coating is dried, the resist is then exposed to a patterned image of ultraviolet radiation to activate the resist material in selected regions and then the exposed portion of the photo resist foil coating is removed by washing prior to further processing steps.

The foils that are coated and cured may be used for the making of masks that are then used to define the electrical conductor patterns on the ceramic substrates known as green sheets or for electronic circuit chip manufacture. The masks may be used in a screening process where a metalized paste is screened through the mask openings and deposited on the green sheet. Alternatively, the conductor patterns may be made by metal vaporization and the metal vapor then depositing and condensing on the green sheet to form the conductor pattern.

The resist material is a commercially available photo resist such as MICROPOSIT 111 available from Shipley Company, Inc. of Newton, Mass. or other photo resist materials available from other suppliers. The example photo resist is a resinous material dissolved in a volatile solvent. The components of the resist solution are 2-ethoxy ethyl acetate, n-butyl acetate, xylene, toluene, Novalac resins and photoactive compounds. The solvent must be removed from the coating prior to imaging and such drying of the coating is known as curing. Due to the extremely fine patterns which are exposed on the resist coatings, the application of the resist and the drying of the resist layer is performed in a clean room environment, using an automated manipulating device or robot. The size of the operating envelope of the robot is limited and accordingly, the resist dryer must be of a relatively small size so that it may be placed in proximity to the robot.

The dryer must also be capable of drying the resist layer in a relatively short time in order that the flow of work progresses in a timely fashion.

Further the resist should be dried such that a uniform drying rate is maintained in order to insure a uniform thickness and quality in the resist layer. The resist layer is very thin, on the order of 25,000 Angstroms. Very slight variations in the thickness will greatly affect the end result after the film is exposed by ultraviolet radiation and the exposed portions removed.

One of the variables in the drying of the resist film is the temperature at which the drying occurs. In order to achieve uniform drying, a uniform temperature in the curing enclosure or chamber is necessary. The control of the heating elements of the dryer is essential and critical to the operation of the device and the efficient and effective curing of the photo resist coating. Typically the larger the oven or drying device, the more uniform the heating of the object, since hot spots and cold regions tend to even out when displaced from the object being heated. In larger ovens the distances may be increased, while the temperature variations are more emphasized in more compact ovens or heater devices. However, in environments where there is limited space, the heating elements must be confined in a smaller device and thus may not be significantly displaced from the item being heated, to insure uniformity of temperature. In a compact dryer unit, it is necessary to resort to other techniques of insuring temperature uniformity.

As resist coatings are dried or cured, the solvent of the resist solution is vaporized or driven off into the atmosphere. If the solvent concentration is built up in the dryer, the evaporation and removal of solvent from the resist layer is inhibited. Accordingly, the concentration of solvent in the atmosphere of the work place is an important factor in the proper curing of the resist layers on the foils.

Heaters and ovens using resistance heaters are well known in the art and examples of such ovens are U.S. Pat. No. 3,074,342 to Wachtel and 4,238,669 to Huntley. The Huntley patent additionally uses a heating lamp such as a quartz bulb to supplement the resistance heaters. Both of the ovens of Wachtel and Huntley are designed to warm or cook food items, where the emissions are not important and the uniformity of the heating is not critical, and no special precautions are taken to effect uniform heating.

U.S. Pat. No. 4,554,437 to Wagner et al. discloses a tunnel oven for the continuous through put of items to be heated. The heating of the oven is accomplished by radiant heaters heating a slab of metal such as steel which is thick enough to create a thermal mass within the oven and emit infra-red radiation to heat the food being passed through the tunnel oven. Heating in an open ended tunnel oven will not be uniform and there is no need to control emissions in the oven atmosphere when cooking food is concerned.

U.S. Pat. No. 3,052,040 to Falanga et al. discloses an air circulation apparatus that uses heated air to heat the devices treated and to remove undesirable gases released by the heat treating process.

None of the above patents address the need for a closely controlled uniform temperature within the oven to critically control the result, heat treating of objects or cooking of food items.

It is an object of the invention to uniformly heat and cure photo resist coatings on foils.

It is another object of the invention to remove the solvent concentrations in the dryer atmosphere to enhance drying uniformity, and to remove the solvent to a point of dispersal or recovery.

It is a still further object of the invention to accomplish the uniformity in heating and drying in a small device.

SUMMARY OF THE INVENTION

A foil, typically a thin sheet of molybdenum, which is to be coated with a thin layer of photo resist is attached to a frame for support and coated with a photo resist solution by flooding of a tank having the frames suspended therein. The frame and the film are then inserted into a chamber for drying. The chamber is an enclosure fabricated from a highly heat conductive metal such as a copper sheet which surrounds the heating cavity on five sides, with only the top open for insertion and removal of the frame and film. The copper sheet chamber is surrounded by electrical resistance strip heaters which are individually controllable. The individual control of the heaters allows the heater strips nearest the opening to be set to a higher temperature to compensate for the effect of the air near the opening cooling the interior of the chamber near the opening.

The copper chamber acts as a heat carrier from the region immediately adjacent to the heater elements to nearby areas that have no heater element immediately adjacent thereto. The copper, being a very good conductor, is effective to conduct the heat from the hotter regions to the cooler regions with very little energy loss and with only a small temperature gradient. The ceramic body surrounding the heaters and copper enclosure is much less of a conductor and thus cools more slowly than the heater and copper enclosure, thereby acting as a heat storage and containment device. This further reduces the temperature gradient across the interior of the copper enclosure.

The copper chamber, although not sealed to all air flow from outside the chamber acts to shield the photo resist coating from contaminants from the surrounding environment and the strip heaters.

The concentration of the resist solvent vapor in the atmosphere of the dryer is reduced to low levels and removed for proper disposal by an exhaust manifold and fan system. This exhaust system acts to pull the solvent vapor enriched air from the heating chamber and thereby reduce the solvent vapor concentration. With reduced solvent vapor concentrations in the air, the solvent in the resist layer is much easier and more rapidly removed enhancing through put of foils and cured resist layers. Without the removal of the partially solvent saturated air in the heating chamber, the air is limited in ability to evaporate the solvent from the resist layer.

If the emissions from the resist layer are toxic or harmful, they may be routed from the exhaust manifold to a solvent recovery device which then would remove the solvent vapors from the air.

Other objects and advantages of the invention and improvements over the prior art will be come apparent or identified in the description of the invention hereinbelow.

BRIEF DESCRIPTION OF THE DRAWINGS

Like reference numerals designate like elements in the several figures of the drawings.

Figure 1:
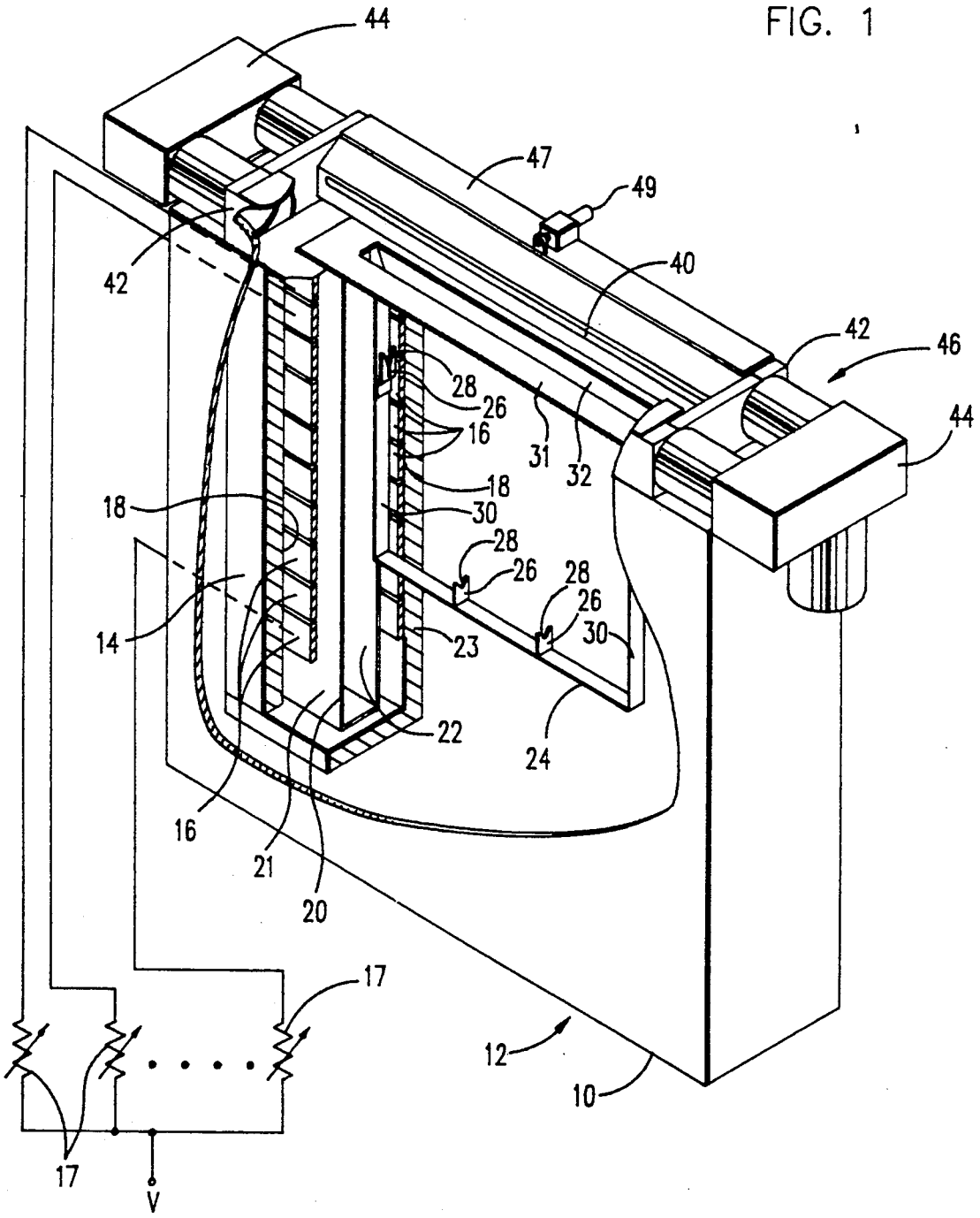
FIG. 1 is a partially cut away perspective view of the photo resist dryer.

DETAILED DESCRIPTION OF THE BEST MODE OF CARRYING OUT THE INVENTION AND THE PREFERRED EMBODIMENT

Referring now to the drawings by reference numeral, a main enclosure 10 is provided to contain the dryer. The main enclosure 10 provides containment as well as the support necessary to fix the other elements of the dryer spatially.

Positioned within the main enclosure 10 of the dryer 12 is ceramic well 14. The ceramic well provides support for the elements of the dryer which are interior to the ceramic well 14, as well as insulation and heat containment to confine the heat to the interior of the ceramic well from heating the main enclosure 10. The ceramic well may be fabricated from sheets or slabs of silicon or other ceramic material positioned or joined together to form a box shaped container open on the top. The interior surfaces of the sides of the ceramic well are provided with strip resistance heating elements 16 of the type that are made by Tempco Heater company, Franklin Park, Illinois under the designation D-85. The heating elements 16 may be attached to the surfaces of the ceramic material or they may be supported separately and positioned within the cavity of the ceramic well 14. The preferred arrangement is to position the heater elements in contact with the exterior surface of the enclosure 20 described below. The heaters 16 are positioned so that the external surfaces 21 of the copper enclosure 20 are substantially covered by the heating elements 16. This greatly reduces the regions where no heat is generated, and consequentially, cool spots.

In order to further even the heat and the temperature within the ceramic well 14, a copper enclosure 20 is placed within the cavity left by the ceramic well 14 and the heaters 16 within the ceramic well 14. The copper enclosure 20 is preferably fabricated to form a box like container open on a single side and of size and shape as to be insertable between or within the cavity formed by the heater elements 16. The heaters 16 are preferably in direct contact with the copper enclosure 20 or immediately adjacent the exterior of the copper enclosure 20. The copper enclosure 20 is preferably conductively heated by the heater elements 16. The copper enclosure 20 is thus heated by contact with the heaters 16 over a large portion of the surface area of the enclosure. The enclosure being fabricated from sheet copper, and highly conductive, the temperature differentials from one region to another are quickly and efficiently compensated for by conduction of heat to the cooler regions. This high conductivity of heat contributes to uniform heating of the copper enclosure 20 and the resultant uniform surface temperature on the inner surface of the copper enclosure 20.

The copper enclosure 20, having two plate like surfaces 22 and narrow side and bottom walls, the plate like surfaces will radiate heat primarily toward any cooler object placed between the plate like surfaces 22. Radiation from the surfaces 22 will continue until the temperature of an object placed between the surfaces 22 is heated to the temperature of surfaces 22.

Figure 2:
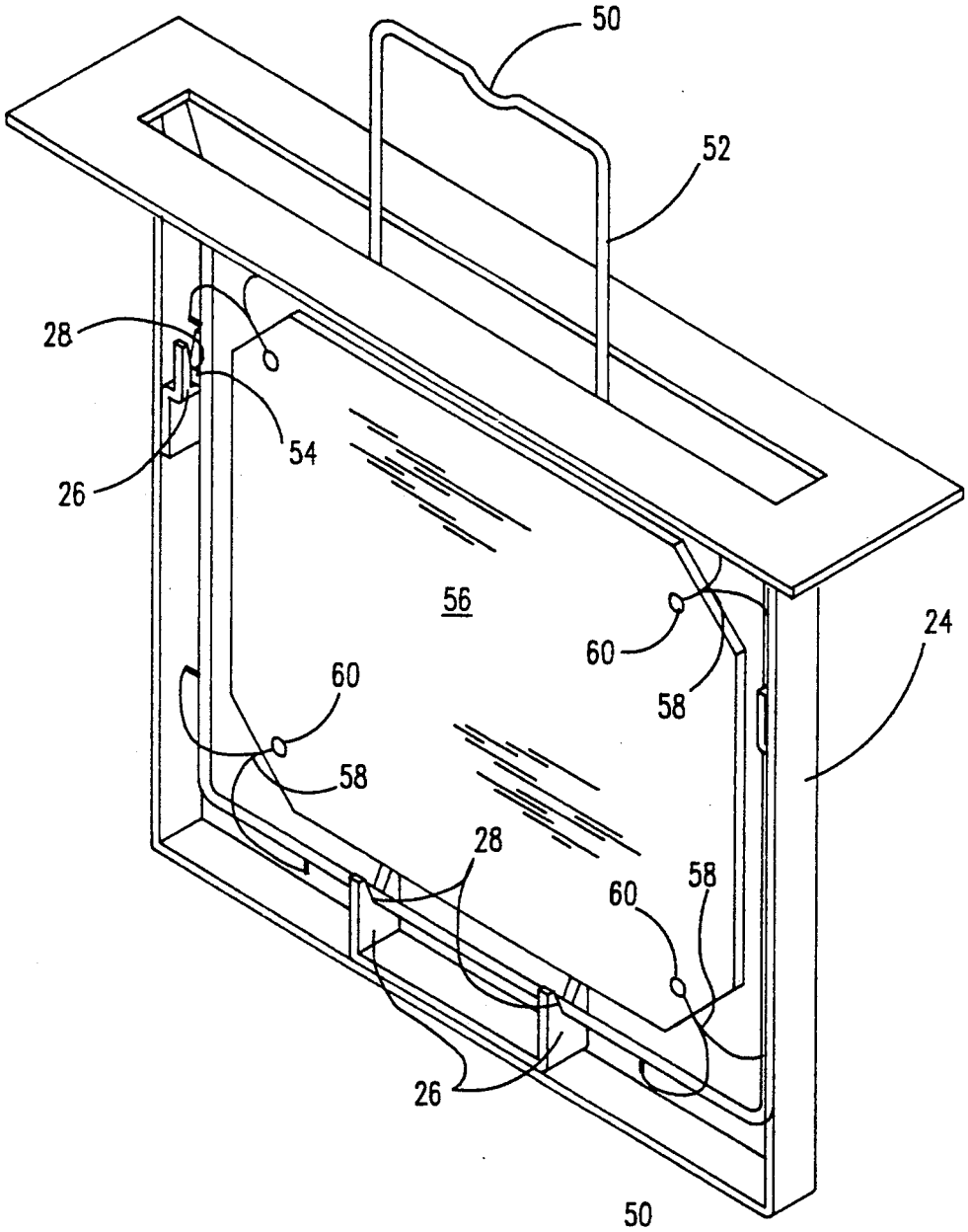
FIG. 2 is a perspective view of the carrier nest and the carrier which holds the coated foil during the coating and curing operation.

In order to support the photo resist coated film 56 in the cavity formed by the copper enclosure 20, a device referred to as a carrier nest 24 is suspended within the heated cavity. The carrier nest 24 is provided with locating tabs 26 having locator notches 28. The tabs 26 and notches 28 are formed to engage a carrier such as is illustrated in FIG. 2.

To support the carrier nest 24 in its operative position within the heated cavity, the depending portions 30 are attached to a flange 31 that is provided with an opening 32 for inserting the carrier into the cavity and its engagement with notches 28. The flange 31 rests on the top surface of the main enclosure 10 and restricts the top opening of cavity 23. The opening 32 in the flange 31 greatly restricts the size of the top opening of the cavity 23 and to some extent restricts the radiation of heat out of the cavity 23 and the cooling of the cavity walls 22, carrier 50, foil 56 and resist coating thereon.

Positioned in proximity to the opening 32 in the flange 31, is an exhaust port 40 which opens into an exhaust manifold 42 to remove toxic gases and solvents released by the heating of the foil and the resist. A manifold 42 is placed on both sides of the opening 32 of flange 31. The manifolds 42 may be then connected to a header box 44 and thence to a vacuum pump, fan or other suction device to reduce the pressure in the manifolds 42. The lowered pressure within the exhaust system 46 pulls any solvent laden air or other fumes or gases through the exhaust port 40 and away from the opening 32 and the cavity.

Some small amount of air may enter the enclosure and pass through the cavity 23 enroute to the exhaust port 40. This will not adversely effect the coating from a disturbance standpoint and is beneficial because it assists in carrying the solvent vapors out of the copper enclosure 20 to the exhaust manifold 42.

To further restrict either the flow of solvent laden air or other gases to the surrounding environment or the cool air surrounding the dryer into proximity to the opening 32 in flange 31 in the interests of reducing contamination of the environment and maintaining a constant, uniform temperature in the cavity 23, a closure or door 47 may be positioned over the vacant region between the manifolds 42 and above the flange 31 and opening 32. Closing the closure or door 47 will help maintain the desired uniformity of temperature within the cavity for proper curing of the resist coating. The closure 47 is preferably mechanically actuated so that it may be integrated into an automated operation, and the door may be closed and opened upon command from a control unit (not shown). The preferred actuator is an air cylinder 49.

Referring now to FIG. 2. the carrier nest 24 is shown removed from the dryer 12. The carrier nest supports the carrier 50. Carrier 50 is preferably a wire formed into a substantially rectangular or other suitable shape with a portion of the wire bent or formed to project upward out of the nest 24 to act a handle or engagement point 52. The lower, preferably horizontal wire extremity 55 engages with and rests in notches 28 of supports 26. On the preferably vertical portions of the carrier 50, pins 55 are attached to and project outward from the carrier to engage notch 28 of support 26 attached to the vertical wall of carrier nest 24.

The carrier 50 may be lifted out of the carrier nest 24, disengaging the carrier from notches 28, by using the handle 52.

Figure 3:
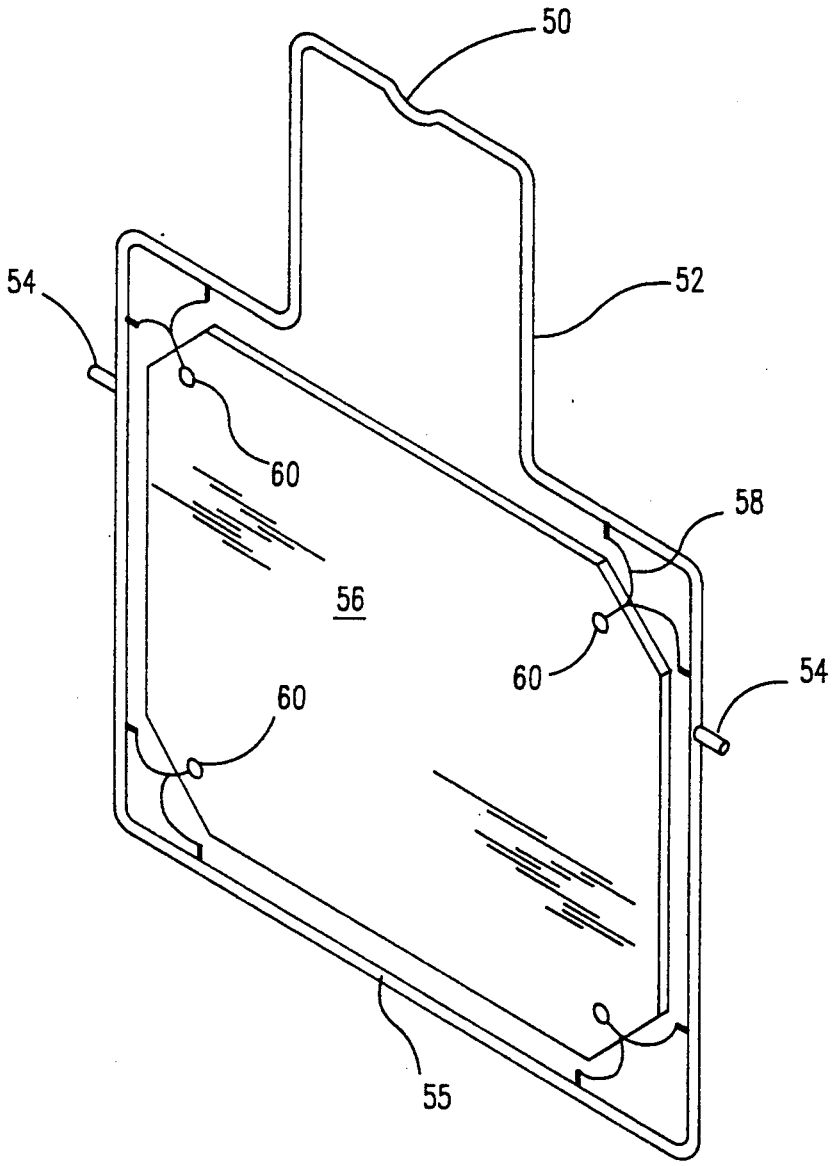
FIG. 3 is a perspective view of the carrier and the foil suspended in the carrier.

Carrier 50 suspends foil 56 within the opening in the carrier 50, by means of springs or clips 58 or such other attaching means as desired, which engage holes 60 in the foil 56 and engage the carrier 50. The action of springs 58 pulls the foil 56 tight and maintains the foil 56 in a flat form suspended within the carrier 50. A view of the carrier 50 removed from carrier nest 24 in FIG. 3 illustrates the pins 54 more advantageously.

Referring back to FIG. 1, while the copper enclosure 20 does much to produce a uniform temperature throughout the cavity within the copper enclosure 20, the heaters 16 may be preferably individually wired and controlled, by conventional variable resistance controls 17, so that an even more balanced and uniform temperature may be maintained. If the heaters 16 are individually wired, the ones located nearest to the opening 32 formed by the flange 30 may be provided more electrical power to cause them to heat to a higher temperature offsetting the slight cooling effect of the air flow across the opening 32, into the exhaust port 40. Should any air flow into the bottom of the copper enclosure 20 unduly cool the lower or other region of the cavity 23, the voltage to the heater in that region may be adjusted to compensate for that temperature aberration. It is to be understood that the ground line from the heater elements is not shown for clarity of the drawings.

Other heaters 16 that prove to not heat uniformly could likewise be adjusted to compensate for heater-to-heater variations in temperatures.

Variations and changes to the invention may be made by one skilled in the art and still remain within the scope of the invention as set forth in the claims.

We claim:

1. A photo resist dryer comprising:

a metal enclosure having five enclosed sides and an open side, at least two of said enclosed sides being parallel to each other and spaced apart to permit the insertion of a support structure therebetween;

a support structure insertable into said enclosure;

a plurality of heating means for heating said enclosure surrounding said enclosure;

a plurality of heating means control means for controlling temperatures of said plurality of said heating means, at least some of said control means individually connected to individual heating means, whereby said plurality of said heating means heats said metal enclosure from the exterior of said metal enclosure and said control means control at least some of said heating means to produce a uniform heating of an object inserted within said enclosure.

2. The photo resist dryer of claim 1 further comprising:

an exhaust manifold proximate said open side of said enclosure, for gathering by-products of said heating of said object.

3. The photo resist dryer of claim 2 wherein said object is coated with a photo resist.

4. The photo resist dryer of claim 1 wherein said support structure comprises an insert positioned within said enclosure and a carrier holding said object within said enclosure.

5. The photo resist dryer of claim 1 further comprises a closure having a first position and a second position to prevent and grant access to said open side of said enclosure and contain environmental contents of said enclosure.

6. The photo resist dryer of claim 1 wherein said enclosure comprises sheet copper.

7. The photo resist dryer of claim 6 wherein said sheet copper enclosure is sealed at all points excepting said open side.

8. The photo resist dryer of claim 7 where in said heating means are in contact with said enclosure exterior.

9. A method of curing photo resist comprising the steps of:

providing an enclosure defining at least five sides of a volume;

heating said enclosure from outside said enclosure to a uniform temperature;

covering an object with a coating of a photo resist solution, said solution comprising a solvent;;

inserting said object with said photo resist coating into said enclosing; and heating said photo resist coating uniformly; and maintaining said object within said enclosure for sufficient time to remove said solvents from said coating.

10. The method of claim 9 further comprising the step of providing a plurality of heaters exterior to said enclosure and controlling said heaters to vary heat output from selected ones of said heaters to heat said enclosure to a uniform temperature over all interior surfaces of said enclosure.

11. The method of claim 10 comprising removing byproducts of said curing of said photo resist from within said enclosure and transporting said by-products away from said enclosure, said by-products comprising said solvent, whereby solvent concentrations in the curing atmosphere are reduced.

12. The method of claim 10 further comprising the step of conducting heat through said enclosure material from regions proximate said heaters to regions displaced from said heaters.

13. A dryer comprising:

a carrier for holding a workpiece to be dried, wherein the carrier has a frame for holding said workpiece;

an exhaust manifold comprising an exhaust slot;

a conductive enclosure adapted to receive said carrier, wherein said enclosure has an end opening over which said header fits;

means for heating said conductive enclosure, said means for heating disposed within an insulating enclosure, said heating means adjustable to vary heat input over the conductive enclosure; and an exhaust header disposed to receive exhaust fumes from said exhaust slot.

* * * * *